US006389674B1

(12) United States Patent
Beavers-La Rue

(10) Patent No.: US 6,389,674 B1
(45) Date of Patent: May 21, 2002

(54) BASKET WEAVING KIT AND METHOD

(76) Inventor: Tanya L. Beavers-La Rue, HC75 Box 88, Kooskia, ID (US) 83539

( * ) Notice: Subject to any disclaimer, the term of this patent is extended or adjusted under 35 U.S.C. 154(b) by 81 days.

(21) Appl. No.: 09/689,946

(22) Filed: Oct. 13, 2000

(51) Int. Cl.[7] ..... D03D 23/00
(52) U.S. Cl. ..... 29/460; 139/29; 147/48
(58) Field of Search ..... 29/433, 449, 460; 383/117; 139/457, 29, 30, 31, 32, 33, 33.5, 35; 147/48

(56) References Cited

U.S. PATENT DOCUMENTS

| | | | | |
|---|---|---|---|---|
| 362,302 A | | 5/1887 | Merriam | |
| 1,170,448 A | * | 2/1916 | Jennings | 383/117 |
| 1,339,063 A | * | 4/1920 | Lloyd | 147/48 |
| 2,511,644 A | * | 6/1950 | Liss | 383/117 |
| 3,347,429 A | | 10/1967 | Ruth, Jr. | |
| 4,096,978 A | | 6/1978 | Noice | |
| 4,730,942 A | * | 3/1988 | Fulcher | 383/117 |
| 5,400,934 A | | 3/1995 | Ducros | |
| 5,449,102 A | | 9/1995 | Sason | |
| 5,979,722 A | * | 11/1999 | Gonzales | 383/177 |

FOREIGN PATENT DOCUMENTS

| | | |
|---|---|---|
| EP | 0 628 265 A1 | 12/1993 |
| EP | 0 691 086 A1 | 5/1995 |

* cited by examiner

*Primary Examiner*—S. Thomas Hughes
*Assistant Examiner*—Jermie E. Cozart

(57) ABSTRACT

A basket weaving kit and method for producing a container to be decorated and used for carrying objects. The basket weaving kit and method includes a plastic cylinder. A plurality of spoke members are for coupling to the plastic cylinder. Each of the spoke members is positionable in substantially parallel spaced relationship to an adjacently positioned spoke member such that the spoke members are positioned around the plastic cylinder. A plurality of reed members are for weaving through the spoke members.

9 Claims, 3 Drawing Sheets

BASKET WEAVING KIT AND METHOD

BACKGROUND OF THE INVENTION

1. Field of the Invention

The present invention relates to knapsacks and more particularly pertains to a new basket weaving kit and method for producing a container to be decorated and used for carrying objects.

2. Description of the Prior Art

The use of knapsacks is known in the prior art. More specifically, knapsacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 362,302; 5,449,102; 5,400,934; 4,069,978; 3,347,429; European Patent No. 0 628 265 A1; and European Patent No. 0 691 086 A1.

While these devices fulfill their respective, particular objectives and requirements, the aforementioned patents do not disclose a new basket weaving kit and method. The inventive device includes a plastic cylinder. A plurality of spoke members are for coupling to the plastic cylinder. Each of the spoke members is positionable in substantially parallel spaced relationship to an adjacently positioned spoke member such that the spoke members are positioned around the plastic cylinder. A plurality of reed members are for weaving through the spoke members.

In these respects, the basket weaving kit and method according to the present invention substantially departs from the conventional concepts and designs of the prior art, and in so doing provides an apparatus primarily developed for the purpose of producing a container to be decorated and used for carrying objects.

SUMMARY OF THE INVENTION

In view of the foregoing disadvantages inherent in the known types of knapsacks now present in the prior art, the present invention provides a new basket weaving kit and method construction wherein the same can be utilized for producing a container to be decorated and used for carrying objects.

The general purpose of the present invention, which will be described subsequently in greater detail, is to provide a new basket weaving kit and method apparatus and method which has many of the advantages of the knapsacks mentioned heretofore and many novel features that result in a new basket weaving kit and method which is not anticipated, rendered obvious, suggested, or even implied by any of the prior art knapsacks, either alone or in any combination thereof.

To attain this, the present invention generally comprises a plastic cylinder. A plurality of spoke members are for coupling to the plastic cylinder. Each of the spoke members is positionable in substantially parallel spaced relationship to an adjacently positioned spoke member such that the spoke members are positioned around the plastic cylinder. A plurality of reed members are for weaving through the spoke members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new basket weaving kit and method apparatus and method which has many of the advantages of the knapsacks mentioned heretofore and many novel features that result in a new basket weaving kit and method which is not anticipated, rendered obvious, suggested, or even implied by any of the prior art knapsacks, either alone or in any combination thereof.

It is another object of the present invention to provide a new basket weaving kit and method which may be easily and efficiently manufactured and marketed.

It is a further object of the present invention to provide a new basket weaving kit and method which is of a durable and reliable construction.

An even further object of the present invention is to provide a new basket weaving kit and method which is susceptible of a low cost of manufacture with regard to both materials and labor, and which accordingly is then susceptible of low prices of sale to the consuming public, thereby making such basket weaving kit and method economically available to the buying public.

Still yet another object of the present invention is to provide a new basket weaving kit and method which provides in the apparatuses and methods of the prior art some of the advantages thereof, while simultaneously overcoming some of the disadvantages normally associated therewith.

Still another object of the present invention is to provide a new basket weaving kit and method for producing a container to be decorated and used for carrying objects.

Yet another object of the present invention is to provide a new basket weaving kit and method which includes a plastic cylinder. A plurality of spoke members are for coupling to the plastic cylinder. Each of the spoke members is positionable in substantially parallel spaced relationship to an adjacently positioned spoke member such that the spoke members are positioned around the plastic cylinder. A plurality of reed members are for weaving through the spoke members.

Still yet another object of the present invention is to provide a new basket weaving kit and method that allows a user to create a container for carrying items.

Even still another object of the present invention is to provide a new basket weaving kit and method that allows a user to create a container that can be decorated by the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
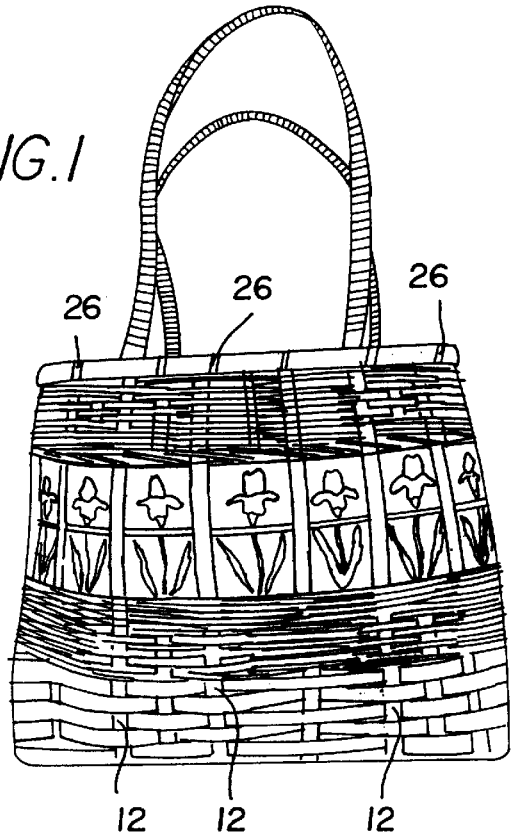
FIG. 1 is an elevational view of a basket of a new basket weaving kit and method according to the present invention.
Figure 3:
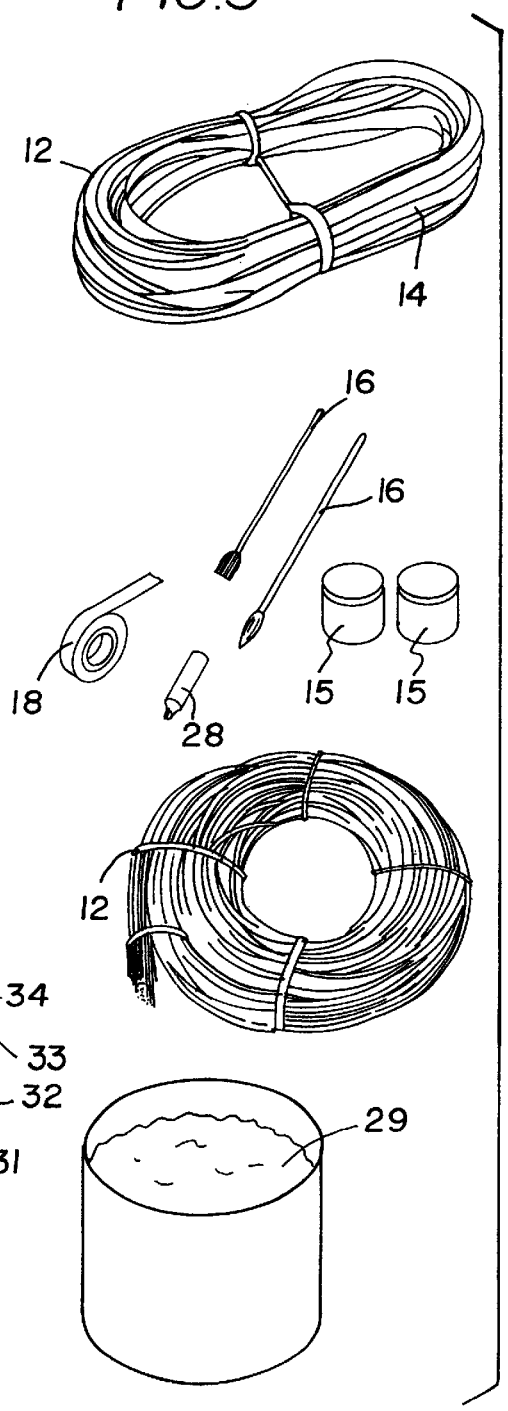
FIG. 3 is a perspective view of the kit of the present invention.
Figure 2:
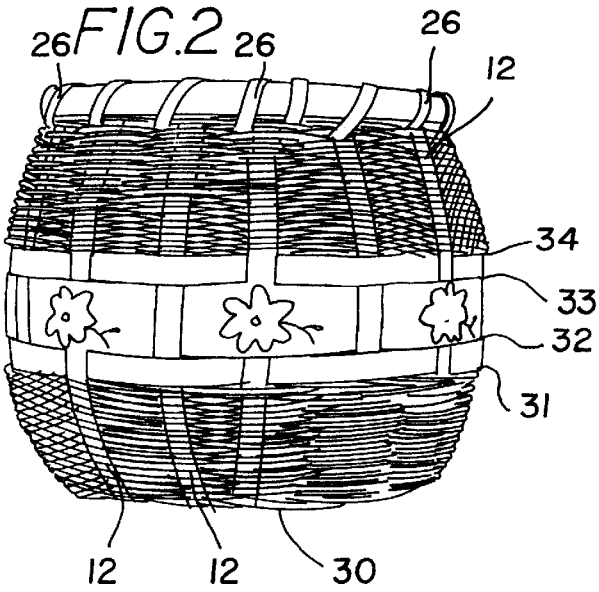
FIG. 2 is a elevational view of an embodiment of the present invention.
Figure 4:
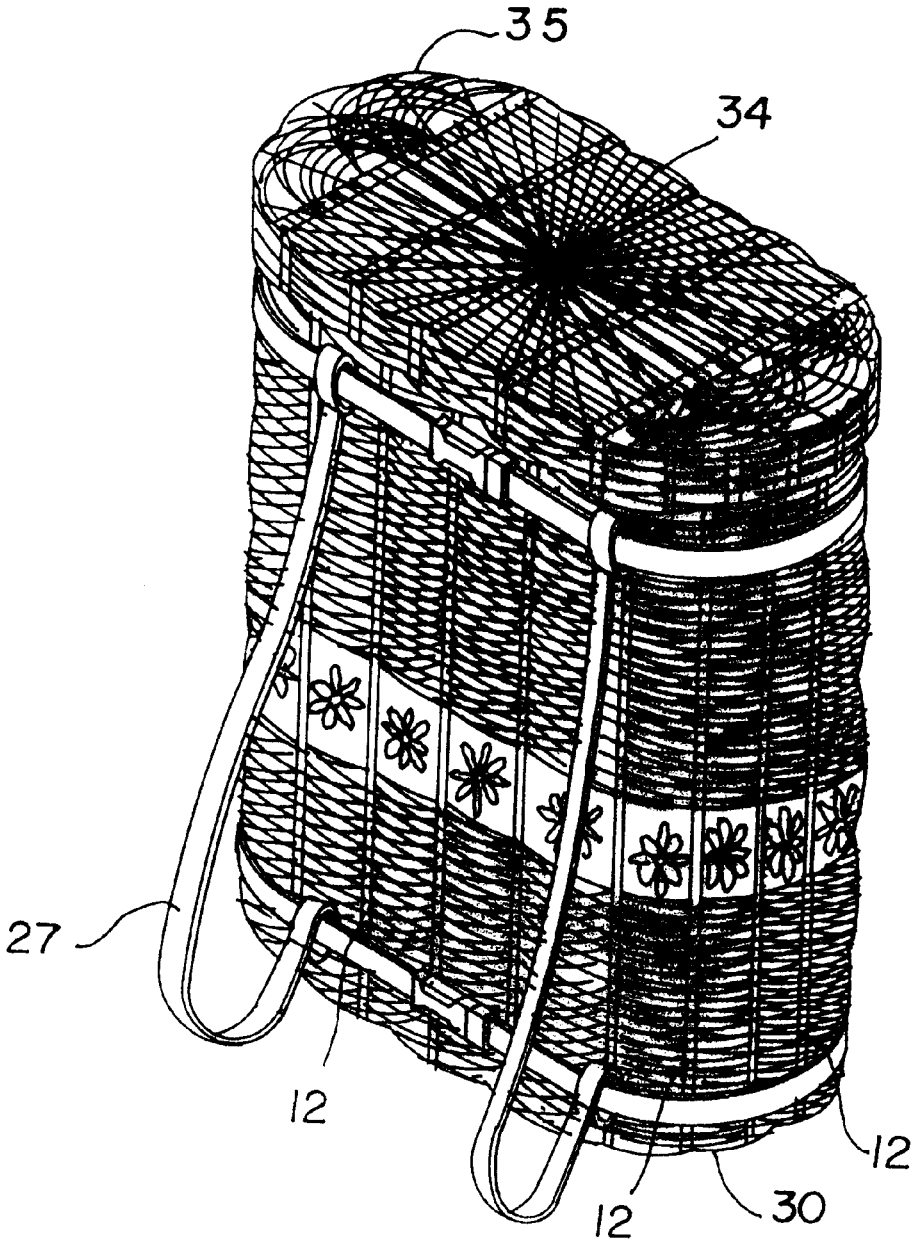
FIG. 4 is a perspective view of an embodiment of the present invention.
Figure 5:
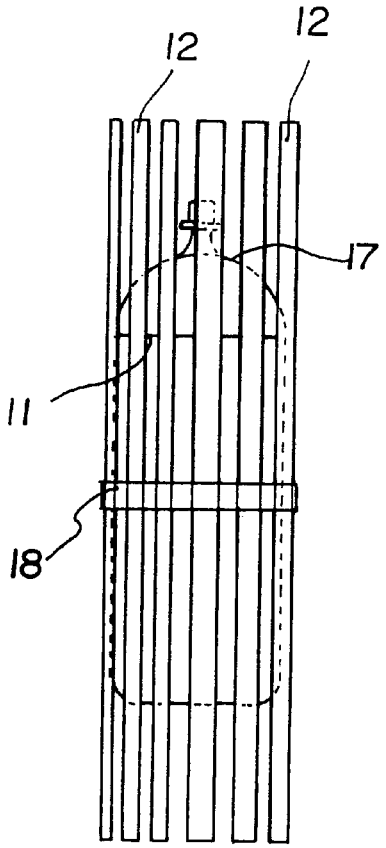
FIG. 5 is a elevational view of an embodiment of the present invention.
Figure 6:
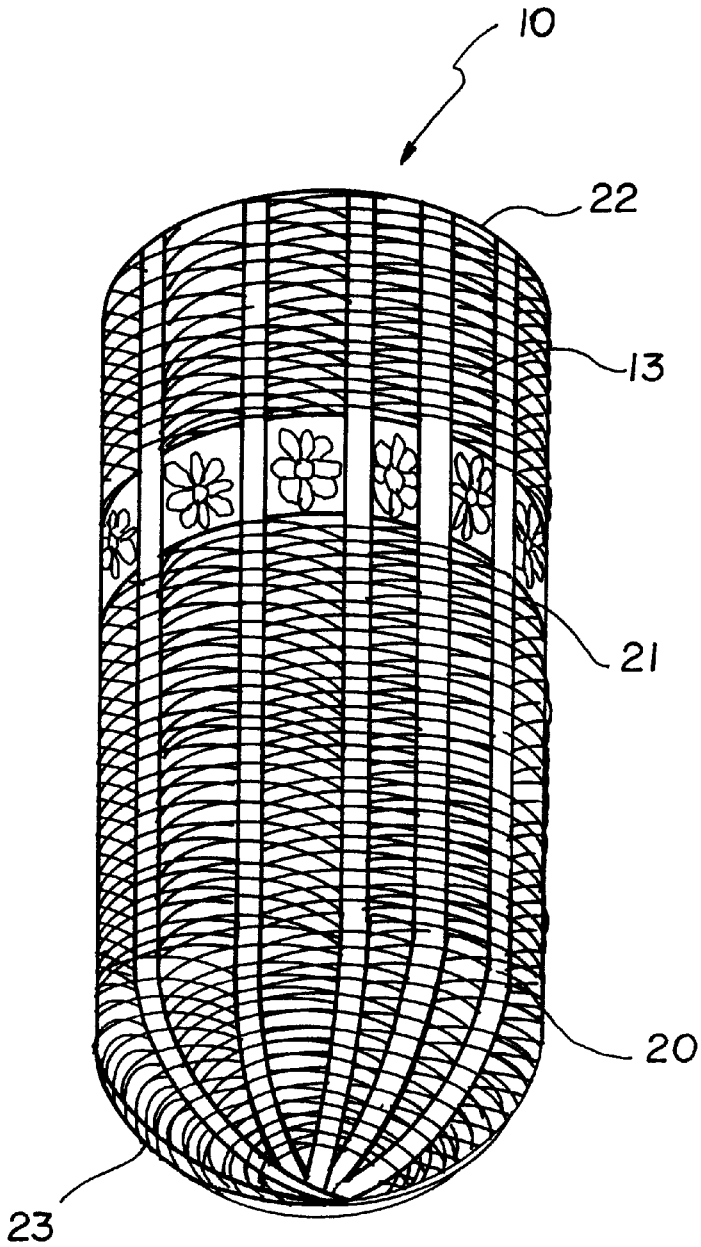
FIG. 6 is a perspective view of the present invention.

With reference now to the drawings, and in particular to FIGS. 1 through 6 thereof, a new basket weaving kit and method embodying the principles and concepts of the present invention and generally designated by the reference numeral 10 will be described.

As best illustrated in FIGS. 1 through 6, the basket weaving kit and method 10 generally comprises a plastic cylinder 11. A plurality of spoke members 12 are for coupling to the plastic cylinder. Each of the spoke members is positionable in a substantially parallel spaced relationship to an adjacently positioned spoke member such that the spoke members are positioned around said plastic cylinder. A plurality of reed members 13 are woven through the spoke members. The reed members include a flat reed 14 having a width of about 2 inches. A plurality of paints 15 and brushes 16 are included for decorating exposed outwardly facing surfaces of the flat reed member after the flat reed member has been woven through the spoke members.

In use, a 2-liter soda bottle 17, tape 18, thirteen ½ inch flat reeds each having a length of 23 inches, one flat reed having a width of one inch, a plurality of ¼ inch flat reeds, and a plurality of round reeds 19 are provided. A top is cut from the soda bottle to form a cylinder having a closed bottom and a generally uniform cross-section along a length of the cylinder. Each of the thirteen ½ inch flat reeds are taped to the cylinder such that each of the ½ inch flat reeds is positioned substantially parallel to an adjacently positioned ½ inch flat reed to form a plurality of spokes. Each of the ½ inch flat reeds are spaced about ¼ of an inch from each adjacent ½ inch flat reed. The ½ inch flat reeds are positioned such that a bottom of each ½ inch flat reed is positioned coplanar with respect to each other. The ½ inch flat reeds are further positioned so that opposite ends of each ½ inch flat reed extends outwardly from an associated edge of the cylinder.

One of the ¼ inch flat reeds is woven through the spokes. The one ¼ flat reed is cut. Ends of the ¼ inch flat reed are overlapped to form a band around the spokes. Weaving, cutting and overlapping of said ¼ inch flat reed is repeated until bands form a lower band of about 2 inches. Tape is removed from the ½ flat reeds.

The round reed is triple woven once around the spokes to form a first triple weave line 20. The 1 inch flat reed is woven around the spokes. The 1 inch flat reed is cut. Ends of said 1 inch flat reed are overlapped. The round reed is triple woven once around the spokes to from a second triple weave line 21. Weaving, cutting and overlapping of the ¼ inch flat reed is repeated to form a top band of about 2 inches.

A top 22 and bottom 23 of the basket is formed using round reed. Top and bottom borders are closed by cutting every other spoke flush with a top of the basket and tucking uncut spokes inside of basket weaving. Overcast stitching is done using round reed. A web 25 is woven across the bottom of the basket for supporting the cylinder. Paints and a paint brush are provided. Outwardly facing exposed surfaces of the one inch flat reed are painted to decorate the basket.

In an embodiment, seven one inch flat spoke reeds each having a length of about 74 inches, eleven one inch flat reeds each having a length of about 68 inches and six one inch flat filler reeds each having a length of about 38 inches are provide. One three inch ash splint having a length of about 80 inches is provided. Two 1 inch flat oval reeds each having a length of about 80 inches, seven one inch flat reeds for weaving and a plurality of round reeds each having a first diameter are provided. A plurality of ½ inch flat reeds, ¼ inch lashing reeds 26, paints, paint brush, harnessing 27, marking tool 28 and water 29 are provided.

Centers of a rough side of each reed are marked. Each reed is soaked for facilitating bending of each reed. Flat spoke reeds are laid horizontally such that the rough side faces up. The filler reeds are laid horizontally such that each filler reed is positioned between adjacently positioned spoke reeds. Centers of the spoke reeds and the filler reeds are lined up.

One of the one inch flat reeds is woven vertically through the spoke reeds and the filler reeds at the aligned centers of the spoke reeds and the filler reeds to form a central vertical reed. Each remaining one inch flat reed is woven through the spoke reeds and the filler reeds such that five of the one inch flat reeds are positioned on each side of the central vertical reed to form a base 30.

Ends of the filler reeds are bent and tucked into the base. Excess ends are cut from the filler reeds. Spokes are bent into a position perpendicular to the base. Six one inch flat reeds are woven through the spoke reeds to form six rows of one inch flat reed.

Round reeds having said first diameter are triple-woven once around through the spoke reeds to form an upper border 31 relative to the six rows of one inch flat reed. Round reed is woven through the spoke reeds to form a first spiral weave portion having a height of about 2 inches. Round reeds having said first diameter are triple-woven once around through the spoke reeds to form an upper border 32 for the first spiral weave portion.

The three inch ash splint is woven through the spoke reeds. Round reeds having said first diameter are triple-woven once around through the spoke reeds to form an upper border 33 for the three inch ash splint. Round reed is woven through the spoke reeds to form a second spiral weave portion having a height of about 2 inches.

Six rows of ½ inch flat reed are woven through the spoke reeds. Round reeds having said first diameter are triple-woven once around through the spoke reeds to form an upper border for the rows of ½ inch flat reeds. Six rows of ½ inch flat reed are woven through the spoke reeds. Round reeds having said first diameter are triple-woven once around through the spoke reeds to form an upper border for the rows of ¼ inch flat reeds.

Round reed is woven through the spoke reeds to form a third spiral weave portion having a height of about 2 inches. Round reeds having said first diameter are triple-woven six times around through the spoke reeds to form an upper border 34 for the third spiral weave portion. Every other spoke reed is cut flush with a top of the basket. Uncut spoke reeds are trimmed and tucked into the weaving inside of the basket.

A first of the one inch flat oval reeds is positioned around an exterior rim of the basket such that the oval side faces outwardly. The first one of the one inch flat oval reeds is trimmed such that ends of the first one of the one inch flat oval reeds overlap more than 2 inches and less than 3 inches. A second of the one inch flat oval reeds is positioned around an interior rim of the basket such that the oval side faces inwardly. The second one of the one inch flat oval reeds is trimmed such that ends of the second one of the one inch flat oval reeds overlap more than 2 inches and less than 3 inches.

The first and second one inch flat oval reeds are lashed together using the ¼ inch lashing reeds by inserting the lashing reeds through every other spoke reed to form a completed basket. The harness is coupled to the completed basket. Exposed exterior surfaces of the ash splint are painted to decorate the completed basket.

Seven one inch vertical flat reeds each having a length of 40 inches, 9 one inch horizontal flat reeds each having a length of 32 inches, and 6 one inch filler flat reeds each having a length of about 32 inches are provided. The vertical flat reeds, the horizontal flat reeds and the filler flat reeds are soaked. Centers of the vertical flat reeds, the horizontal flat reeds and the filler flat reeds are marked.

The horizontal flat reeds are laid horizontally in substantially parallel orientation to each other rough side up. The filler flat reeds are laid horizontally such that each filler flat reed is positioned between adjacently positioned horizontal flat reeds. Centers of the horizontal flat reeds and said filler flat reeds are lined up.

One of the vertical flat reeds is woven through the horizontal flat reeds and the filler flat reeds to form a central vertical flat reed 35. Each remaining vertical flat reed is woven through the horizontal flat reeds and the filler flat reeds such that 3 of the vertical flat reeds are positioned on each side of the central vertical flat reed to form a lid base 36. Ends of the filler flat reeds are bent and tucked into the lid base. Excess ends from the filler flat reeds are cut.

Round reed having a second diameter is woven through the horizontal flat reeds using a chasing weave. The round reed is packed to fit an opening of the completed basket. The horizontal flat reed is bent over the completed basket such that the lid base covers the opening. Triple-weaving is used around through the horizontal flat reeds to form a rim portion. Every other horizontal flat reed is cut flush with the rim portion. The uncut horizontal flat reeds are trimmed and tucked into the weaving inside of rim portion. Round reed having said first diameter is overcast stitched around the rim portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of weaving a basket, the steps of the method comprising:

providing a plastic cylinder, a plurality of flat spoke members, and a plurality of reed members for weaving through said spoke members, said reed members including round reed members and flat reed members;

coupling said spoke members to said plastic cylinder, such that each of said spoke members is positioned in substantially parallel spaced relationship to an adjacently positioned spoke member;

weaving one of said round reed members through said spoke members until said spoke members are held in position by said round reed member;

removing said spoke members from said plastic cylinder;

positioning said spoke members to begin forming a selectable shape of said basket;

weaving additional round reed members through said spoke members to form said basket;

tucking a loose end of each of said round reed members between said spoke members when each said round reed member has been woven through said spoke members.

2. The method of claim 1, wherein one of said flat reed members has a width of about 2 inches, the steps of the method further comprising:

weaving said flat reed member having said width of about 2 inches through said spoke members to form a single band extending around said basket.

3. The method of claim 2, the steps of the method further comprising:

providing a plurality of paints and brushes; and decorating outwardly facing exposed surfaces of said flat reed member having said width of about 2 inches using said paints.

4. The method of claim 3, the steps of the method further comprising:

triple-weaving said round reed members through said spoke members to form a lower framing band around said basket immediately prior to weaving said flat reed having a width of about 2 inches through said spoke members; and triple-weaving said round reed members through said spoke members to form an upper framing band around said basket immediately after weaving said flat reed having a width of about 2 inches through said spoke members whereby said lower framing band and said upper framing band abut respective lower and upper edges of said flat reed having said width of about 2 inches.

5. The method of claim 1, the steps of the method further comprising:

triple-weaving to form a border band around said basket when changing between round and flat reed members whereby said border band forms a visual distinction between portions of said basket formed by weaving said round and flat reed members.

6. A method of weaving a basket for holding water and flowers, the steps of the method comprising:

providing a 2-liter soda bottle, tape, thirteen ½ inch flat reeds each having a length of 23 inches, one flat reed having a width of one inch, a plurality of ¼ inch flat reeds, and a plurality of round reeds;

cutting a top from said soda bottle to form a cylinder having a closed bottom and a generally uniform cross-section along a length of said cylinder;

taping each of said thirteen ½ inch flat reeds to said cylinder such that each of said ½ inch flat reeds is positioned substantially parallel to an adjacently positioned ½ inch flat reed to form a plurality of spokes, each of said ½ inch flat reeds being spaced about ¼ of an inch from each adjacent ½ inch flat reed, said ½ inch flat reeds being positioned such that a bottom of each ½ inch flat reed is positioned coplanar with respect to each other, said ½ inch flat reeds further being positioned so that opposite ends of each said ½ inch flat reed extend outwardly from an associated edge of said cylinder;

weaving one of said ¼ inch flat reeds through said spokes;

cutting said one ¼ flat reed;

overlapping ends of said ¼ inch flat reed to form a band around said spokes;

repeating weaving cutting and overlapping of said ¼ inch flat reed until bands form a lower band of about 2 inches;

removing tape from said ½ flat reeds;

triple-weaving round reed once around said spokes to form a first triple weave line;

weaving said 1 inch flat reed around said spokes;

cutting said 1 inch flat reed;

overlapping ends of said 1 inch flat reed;

triple-weaving round reed once around said spokes to from a second triple weave line;

repeat weaving cutting and overlapping of said ¼ inch flat reed to form a top band of about 2 inches;

forming a top and bottom of basket using round reed;

closing top and bottom borders by cutting every other spoke flush with a top of the basket and tucking uncut spokes inside of basket weaving, then overcast stitching using round reed; and weaving a web across said bottom of basket for supporting said cylinder.

7. The method of claim 6, the steps of the method further comprising:

providing paints, and a paint brush; and painting outwardly facing exposed surfaces of said one inch flat reed to decorate said basket.

8. A method of weaving a carrying basket, the steps of the method comprising:

providing seven one inch flat spoke reeds each having a length of about 74 inches, eleven one inch flat reeds each having a length of about 68 inches, six one inch flat filler reeds each having a length of about 38 inches, one three inch ash splint having a length of about 80 inches, two 1 inch flat oval reeds each having a length of about 80 inches, seven one inch flat reeds for weaving, a plurality of round reeds each having a first diameter, ¼ inch lashing reeds, a plurality of ½ inch flat reeds, paints, paint brush, harnessing, marking tool, water;

marking centers of a rough side of each reed;

soaking each reed for facilitating bending of each reed;

laying flat spoke reeds horizontally such that said rough side faces up;

laying said filler reeds horizontally such that each filler reed is positioned between adjacently positioned spoke reeds;

lining up centers of said spoke reeds and said filler reeds;

weaving one of said one inch flat reeds vertically through said spoke reeds and said filler reeds at aligned centers of said spoke reeds and said filler reeds to form a central vertical reed;

weaving each remaining one inch flat reed through said spoke reeds and said filler reeds such that 5 of said one inch flat reeds are positioned on each side of said central vertical reed to form a base;

bending and tucking ends of said filler reeds into said base;

cutting excess ends from said filler reeds;

bending spokes into a position perpendicular to said base;

weaving six one inch flat reeds through said spoke reeds to form six rows of one inch flat reed;

triple-weaving once around through said spoke reeds using round reeds having said first diameter to form an upper border relative to said six rows of one inch flat reed;

weaving round reed through said spoke reeds to form a first spiral weave portion having a height of about 2 inches;

triple-weaving once around through said spoke reeds using round reeds having said first diameter to form an upper border for said first spiral weave portion;

weaving said three inch ash splint through said spoke reeds;

triple-weaving once around through said spoke reeds using round reeds having said first diameter to form an upper border for said three inch ash splint;

weaving round reed through said spoke reeds to form a second spiral weave portion having a height of about 2 inches;

weaving six rows of ½ inch flat reed through said spoke reeds;

triple-weaving once around through said spoke reeds using round reeds having said first diameter to form an upper border for said rows of ½ inch flat reeds;

weaving six rows of ½ inch flat reed through said spoke reeds;

triple-weaving once around through said spoke reeds using round reeds having said first diameter to form an upper border for said rows of ¼ inch flat reeds;

weaving round reed through said spoke reeds to form a third spiral weave portion having a height of about 2 inches;

triple-weaving six times around through said spoke reeds using round reeds having said first diameter to form an upper border for said third spiral weave portion;

cutting every other spoke reed flush with a top of said basket;

trimming and tucking uncut spoke reeds into weaving inside of said basket;

positioning a first of said one inch flat oval reeds around an exterior rim of said basket such that oval side faces outwardly;

trimming said first one of said one inch flat oval reeds such that ends of said first one of said one inch flat oval reeds overlap more than 2 inches and less than 3 inches;

positioning a second of said one inch flat oval reeds around an interior rim of said basket such that oval side faces inwardly;

trimming said second one of said one inch flat oval reeds such that ends of said second one of said one inch flat oval reeds overlap more than 2 inches and less than 3 inches;

lashing said first and second one inch flat oval reeds together using said ¼ inch lashing reeds by inserting lashing reeds through every other spoke reed to form a completed basket;

coupling said harness to said completed basket; and painting exposed exterior surfaces of said ash splint to decorate said completed basket.

9. The method of claim 8, the steps of the method further comprising:

providing seven one inch vertical flat reeds each having a length of 40 inches, 9 one inch horizontal flat reeds each having a length of 32 inches, and 6 one inch filler flat reeds each having a length of about 32 inches;

soaking said vertical flat reeds, said horizontal flat reeds and said filler flat reeds;

marking centers of said vertical flat reeds, said horizontal flat reeds and said filler flat reeds;

laying said horizontal flat reeds horizontally in substantially parallel orientation to each other rough side up;

laying said filler flat reeds horizontally such that each filler flat reed is positioned between adjacently positioned horizontal flat reeds;

lining up centers of said horizontal flat reeds and said filler flat reeds;

weaving one of said vertical flat reeds through said horizontal flat reeds and said filler flat reeds to form a central vertical flat reed;

weaving each remaining vertical flat reed through said horizontal flat reeds and said filler flat reeds such that 3 of said vertical flat reeds are positioned on each side of said central vertical flat reed to form a lid base;

bending and tucking ends of said filler flat reeds into said lid base;

cutting excess ends from said filler flat reeds;

weaving round reed having a second diameter through said horizontal flat reeds using a chasing weave;

packing said round reed to fit an opening of said completed basket;

bending said horizontal flat reed over said completed basket such that said lid base covers said opening;

triple-weaving around through said horizontal flat reeds to form a rim portion;

cutting every other horizontal flat reed flush with said rim portion;

trimming and tucking uncut horizontal flat reeds into weaving inside of rim portion; and overcast stitching round reed having said first diameter around said rim portion.

* * * * *